US007294213B2

(12) United States Patent
Warner et al.

(10) Patent No.: US 7,294,213 B2
(45) Date of Patent: Nov. 13, 2007

(54) AIRCRAFT STRUCTURAL MEMBER MADE OF AN AL-CU-MG ALLOY

(75) Inventors: Timothy Warner, Voreppe (FR); Ronan Dif, Saint Etienne de Saint Geoirs (FR); Bernard Bes, Seyssins (FR); Herve Ribes, Issoire (FR)

(73) Assignee: Pechiney Rhenalu, Paris (FR)

( * ) Notice: Subject to any disclaimer, the term of this patent is extended or adjusted under 35 U.S.C. 154(b) by 377 days.

(21) Appl. No.: 10/612,878

(22) Filed: Jul. 7, 2003

(65) Prior Publication Data

US 2004/0086418 A1 May 6, 2004

(30) Foreign Application Priority Data

Jul. 11, 2002 (FR) ..... 02 08737

(51) Int. Cl.
*C22C 21/12* (2006.01)
*C22F 1/057* (2006.01)

(52) U.S. Cl. ..... 148/417; 420/533; 420/535; 420/543; 148/693; 148/690

(58) Field of Classification Search ..... 148/417, 148/693, 690; 420/533, 535, 543
See application file for complete search history.

(56) References Cited

U.S. PATENT DOCUMENTS

| | | | | |
|---|---|---|---|---|
| 3,333,990 | A | 8/1967 | Brown et al. | |
| 3,826,688 | A | 7/1974 | Levy | |
| 4,336,075 | A | 6/1982 | Quist et al. | |
| 5,137,686 | A | 8/1992 | Rioja | |
| 5,213,639 | A | 5/1993 | Colvin et al. | |
| 5,376,192 | A | 12/1994 | Cassada, III | |
| 5,512,112 | A | 4/1996 | Cassada, III | |
| 5,593,516 | A | 1/1997 | Cassada, III | |
| 5,630,889 | A | 5/1997 | Karabin | |
| 5,652,063 | A | 7/1997 | Karabin | |
| 5,879,475 | A | 3/1999 | Karabin | |
| 6,077,363 | A * | 6/2000 | Heymes et al. | 148/417 |
| 6,562,154 | B1 * | 5/2003 | Rioja et al. | 148/415 |

FOREIGN PATENT DOCUMENTS

| | | | |
|---|---|---|---|
| EA | 0 473 122 | A | 3/1992 |
| EA | 0 731 185 | A | 9/1996 |
| EA | 1 045 043 | A | 10/2000 |
| EP | 0731185 | | 9/1996 |
| EP | 0623462 | | 5/1998 |
| EP | 1170394 | | 1/2002 |
| GB | 1 133 113 | A | 11/1968 |
| JP | 03236441 | A * | 10/1991 |
| JP | A-H03-236441 | | 10/1991 |

OTHER PUBLICATIONS

Ohsaki, S. et al., Fracture Toughness and Stress Corrosion Cracking of Aluminum-Lithium Alloys 2090 and 2091, Corrision Science, vol. 38, No. 5, pp. 793-802, 1996.
Hatch, J. E., Properties and Physical Metallurgy, American Society for Metals, pp. 1-5, May 1984.

* cited by examiner

*Primary Examiner*—Roy King
*Assistant Examiner*—Janelle Morillo
(74) *Attorney, Agent, or Firm*—Womble Carlyle Sandridge & Rice, PLLC

(57) ABSTRACT

The invention relates to a work-hardened product, particularly a rolled, extruded or forged product, made of an alloy with the following composition (% by weight):

Cu 3.8-4.3; Mg 1.25-1.45; Mn 0.2-0.5; Zn 0.4-1.3; Fe<0.15; Si<0.15; Zr≦0.05; Ag<0.01, other elements <0.05 each and <0.15 total, remainder Al treated by dissolution, quenching and cold strain-hardening, with a permanent deformation of between 0.5% and 15%, and preferably between 1.5% and 3.5%. Cold strain-hardening can be achieved by controlled tension and/or cold transformation, for example rolling, die forging or drawing. This cladded metal plate type product is a suitable element to be used as aircraft fuselage skin.

67 Claims, No Drawings

AIRCRAFT STRUCTURAL MEMBER MADE OF AN AL-CU-MG ALLOY

CROSS-REFERENCE TO RELATED APPLICATION

The present application claims priority under 35 USC 119 to French Application No. 0208737 filed Jul. 11, 2002, the content of which is incorporated herein by reference in its entirety.

BACKGROUND OF THE INVENTION

1. Field of the Invention

The present invention relates generally to aircraft structural members, and more particularly to sheet and plate suitable for wide body commercial aircraft fuselages as well as associated methods.

2. Description of Related Art

The fuselage of wide body commercial aircraft is typically composed of a skin made of AlCuMg type alloy metal sheet or plate, and longitudinal stiffeners (stringers) and circumferential frames. A frequently used alloy is type 2024, which has the following chemical composition (% by weight) according to the Aluminum Association designation or to standard EN 573-3:

Si<0.5, Fe<0.5, Cu 3.8-4.9, Mg 1.2-1.8, Mn 0.3-0.9, Cr<0.10, Zn<0.25, Ti<0.15.

Variants of this alloy are also used. These structural members are expected to provide a compromise between several properties such as mechanical strength (i.e. static mechanical characteristics), damage tolerance (fracture toughness and cracking rate in fatigue), fatigue resistance (particularly oligocyclic), resistance to different forms of corrosion, and formability. Resistance to creep can be critical in some cases, particularly for supersonic aircraft.

Various alternative solutions have been proposed in order to improve the compromise between the various required properties, and particularly mechanical strength and toughness. Boeing has developed the 2034 alloy with composition:

Si<0.10, Fe<0.12, Cu: 4.2-4.8, Mg 1.3-1.9, Mn 0.8-1.3, Cr<0.05, Zn<0.20, Ti<0.15, Zr 0.08-0.15.

This alloy is disclosed in patent EP 0 031 605 (U.S. Pat. No. 4,336,075). It has a better specific yield stress than 2024 in the T351 state, due to the increased contents of manganese and the addition of another anti-recrystallising agent (Zr), and has improved toughness and resistance to fatigue.

U.S. Pat. No. 5,652,063 (Alcoa) relates to an aircraft structural member made from an alloy with composition (% by weight):

Cu: 4.85-5.3, Mg: 0.51-1.0, Mn: 0.4-0.8, Ag: 0.2-0.8, Si<0.1, Fe<0.1, Zr<0.25, where Cu/Mg is between 5 and 9.

Sheet metal made from this alloy in the T8 state has a yield stress >77 ksi (531 MPa). The alloy is intended particularly for supersonic aircraft.

EP Patent 0 473 122 (U.S. Pat. No. 5,213,639) by Alcoa discloses an alloy recorded by the Aluminum Association as 2524, with composition Si<0.10, Fe<0.12, Cu 3.8-4.5, Mg 1.2-1.8, Mn 0.3-0,9, that may possibly contain another anti-recrystallising agent (Zr, V, Hf, Cr, Ag or Sc). This alloy is intended particularly for thin sheets for a fuselage and has better toughness and resistance to crack propagation than 2024.

EP Patent Application 0 731 185 assigned to Pechiney Rhenalu relates to an alloy subsequently recorded under No. 2024A, with composition Si<0.25, Fe<0.25, Cu 3.5-5, Mg 1-2, Mn<0.55 with the relation 0<(Mn-2Fe)<0.2. Thick plates made of this alloy have improved toughness and low residual stresses, without any loss of other properties.

U.S. Pat. No. 5,593,516 (Reynolds) relates to an alloy for aeronautical applications containing 2.5 to 5.5% Cu and 0.1 to 2.3% Mg, in which the contents of Cu and Mg are kept below their solubility limit in aluminium, and are related by the following equations:

$$Cu_{max}=5.59-0.91\ Mg \text{ and } Cu_{min}=4.59-0.91\ Mg.$$

The alloy may also contain Zr<0.20%, V<0.20%, Mn<0.80%, Ti<0.05%, Fe<0.15%, Si<0.10%.

U.S. Pat. Nos. 5,376,192 and 5,512,112, relate to alloys of this type containing 0.1 to 1% silver. Note that the use of silver in this type of alloy increases the production cost and introduces difficulties in recycling of fabrication waste.

EP Patent Application 1 170 394 A2 (Alcoa) describes four types of AlCu alloys with the following composition, respectively:

Cu 4.08, Mn 0.29, Mg 1.36, Zr 0.12, Fe 0.02, Si 0.01;

Cu 4.33, Mn 0.30, Mg 1.38, Zr 0.10, Fe 0.01, Si 0.00;

Cu 4.09, Mn 0.58, Mg 1.35, Zr 0.11, Fe 0.02, Si 0.01; and

Cu 4.22, Mn 0.66, Mg 1.32, Zr 0.10, Fe 0.01, Si 0.01.

The '394 patent describes how to transform these products into sheet metal with an elongated grain structure, in which the grains have a length to thickness ratio of more than 4. If a certain, specific microstructure and a clearly defined texture are obtained, this product has good mechanical strength properties and damage tolerance. One of the disadvantages of these alloys is that they are based on high purity aluminium (very low silicon and iron content), which is expensive. Another Alcoa patent, U.S. Pat. No. 5,630,889, dicloses sheet metal in the T6 or T8 state made of an AlCuMg alloy containing:

Cu 4.66, Mg 0.81, Mn 0.62, Fe 0.06, Si 0.04, Zn 0.36%.

The addition of silver is said to improve the properties of this alloy. However, silver is an expensive element and it limits the recycling of products obtained in this way and production waste from these products, which even further contributes to increasing the cost price of the products.

SUMMARY OF THE INVENTION

A purpose of this invention was to obtain aircraft structural members, and particularly fuselage members comprising an AlCuMg alloy with an improved damage tolerance, at least an equivalent mechanical strength, and improved resistance to corrosion in comparison with the prior art, without the need to add expensive elements that are problematic for recycling.

In accordance with these and other objects, the present invention is directed toward a work-hardened product, and particularly in some embodiments, a rolled, extruded or forged product, made of an alloy with the following composition (% by weight):

Cu 3.80-4.30, Mg 1.25-1.45, Mn 0.20-0.50, Zn 0.40-1.30, Zr<0.05, Fe<0.15, Si<0.15, Ag<0.01.

other elements <0.05 each and <0.15 total, remainder Al, the product optionally being treated by solution heat treatment, quenching and cold strain-hardening, with a permanent deformation of between 0.5% and 15%, and preferably between 1% and 5%, and even more preferably between 1.5% and 3.5%. Cold strain-hardening can be achieved, for example, by controlled stretching and/or cold transformation, for example rolling or drawing.

In further accordance with the present invention there is provided a structural member suitable for aeronautical construction, particularly an aircraft fuselage member, made from such a work-hardened product, and particularly from such a rolled product.

The present invention is further directed to methods as well as products manufactured using certain alloys and/or methods.

Additional objects, features and advantages of the invention will be set forth in the description which follows, and in part, will be obvious from the description, or may be learned by practice of the invention. The objects, features and advantages of the invention may be realized and obtained by means of the instrumentalities and combination particularly pointed out in the appended claims.

DETAILED DESCRIPTION OF A PREFERRED EMBODIMENT

Unless mentioned otherwise, all information about the chemical composition of alloys is expressed as a percent by mass. Consequently, in a mathematical expression "0.4 Zn" means 0.4 times the zinc content expressed as a percent by weight; this applies correspondingly to other chemical elements. The designation of alloys follows the rules of the Aluminum Association. Metallurgical tempers are defined in European standard EN 515. Unless mentioned otherwise, static mechanical characteristics, in other words the ultimate tensile strength (UTS) $R_m$, the yield stress (YS) $R_{p0.2}$ and the elongation A, are determined by a tensile test according to standard EN 10002-1. The term "extruded product" includes products said to be "drawn", in other words products that are produced by extrusion followed by drawing.

In certain efficient AlCuMg alloys according to the prior art for the fabrication of members of an aircraft fuselage structure, good toughness is obtained by using very low iron and silicon levels, and limiting the copper and magnesium contents to facilitate dissolution of coarse intermetallic particles. In order to achieve a sufficiently high mechanical strength, those skilled in the art are inclined to maintain a significant content of manganese, since manganese contributes to hardening of the alloy. Almost all alloys in the 2xxx series contain no more than 0.25% zinc.

Products of the present invention can be, for example, rolled, extruded or forged products made of an AlCuMg alloy treated, for example, by solution heat treatment, quenching and cold strain-hardening, and in which the compromise between the different required usage properties is better than was possible in prior art products used for the same application.

The copper content in an alloy according to the invention is advantagesously between 3.80 and 4.30%, and more preferably between 4.05 and 4.30%. As such, the copper content in alloys of the present invention are preferably in the lower half of the content interval specified for the 2024 alloy, so as to limit the residual volume fraction of coarse copper particles. For the same reason, the magnesium content interval, which is advantageously between 1.25 and 1.45% and more preferably between 1.28 and 1.42% is offset downwards compared with the value for 2024. The manganese content is preferably kept between 0.20 and 0.50%, more preferably between 0.30 and 0.50 and even more preferably between 0.35 and 0.48%. Use of the invention generally does not require any significant addition of zirconium and levels of zirconium are generally not more than about 0.05%.

Advantageously careful control of the zinc content is preferably made, particularly since the present alloy typically has a reduced content of copper, magnesium and manganese. The zinc content is preferably between 0.40 and 1.30%, particularly preferably between 0.50 and 1.10% and even more preferably between 0.50 and 0.70%. In one advantageous embodiment, when the copper, magnesium and manganese contents are less than 4.20%, 1.38% and 0.42% respectively, it is preferable if the zinc content is equal to at least (1.2xCu−0.3xMg+0.3xMn−3.75).

According to the Applicant's observations, a reduction in the content of copper, magnesium and manganese and the addition of a certain controlled quantity of zinc, results in metal sheets and plates that have approximately the same mechanical strength but a better damage tolerance than is possible with metal sheets and plates that do not contain this added zinc. At the same time, their formability is at least as good and they have better corrosion resistance.

Silicon and iron contents are each preferably kept below 0.15%, and more preferably below 0.10%, to achieve good toughness. Those skilled in the art know that reducing the iron and silicon content improves the damage tolerance of AlCuMg and AlZnMgCu alloys used in aeronautical construction (see the article by J. T. Staley, "Microstructure and Toughness of High Strength Aluminium Alloys" published in "Properties related to Fracture Toughness", ASTM STP605, ASTM, 1976, pp. 71-103, which is incorporated herein by reference in its entirety.). However, it is only in certain cases (depending on the alloy type and the target application) that the improved tolerance to damage related to the use of an aluminium containing less than 0.06% iron and silicon disclosed by Staley is sufficiently high to be useful. In this regard, it is generally not necessary to maintain the content of iron and the content of silicon at levels less than 0.06%, since with the instant alloy composition, the damage tolerance is already very good.

Finally, unlike alloys described, for example, in U.S. Pat. Nos. 5,376,192, 5,512,112 and U.S. Pat. No. 5,593,516, the present alloy does not necessarily require an addition of silver or any other element that could increase the production cost of the alloy and pollute other alloys produced on the same site by recycling of manufacturing waste.

A preferred manufacturing process for making the instant alloy generally comprises casting ingots, if the product to be made is a rolled metal plate or sheet, or billets if it is an extruded section or a forged part. The plate or the billet is scalped and then homogenised between 450 and 500° C. The next step is hot transformation by rolling, extrusion or forging, possibly followed by a cold transformation step. The partly finished rolled, extruded or forged product is then solution heat treated at between 480 and 505° C., so that this dissolution is as complete as possible, in other words the maximum amount of potentially soluble phases and particularly $Al_2Cu$ and $Al_2CuMg$ precipitates are actually put into solution. The dissolution quality may be evaluated by a differential enthalpy analysis (AED), by measuring the specific energy using the area of the peak on the thermogram. This specific energy must preferably be less than 2 J/g.

The next step is quenching with cold water, followed by cold strain-hardening leading to permanent elongation of between 0.5% and 15%. This cold strain-hardening may consist of controlled tension with a permanent elongation between 1 and 5%, bringing the product into a T351 state. Controlled tension with a permanent elongation of between 1.5% and 3.5% is preferred. Cold transformation by rolling may also be used for metal plates, or by drawing for sections, with a permanent elongation of up to 15%, bringing the product into the T39 state or the T3951 state, if rolling or drawing are combined with stretching. Finally, the product is aged naturally at ambient temperature. The final microstructure is generally largely recrystallised, with relatively fine and fairly equiaxial grains.

A product according to this invention is useful, for example, as a structural member of an aircraft structure, and particularly as a structural member for the skin of a fuselage. These metal sheets or plates are preferably cladded sheets or plates, preferably between 1 and 16 mm thick, and preferably have very good resistance to intergranular corrosion and to corrosion on a riveted assembly. Their ultimate tensile strength in the L and/or TL direction is advantageously more than 430 MPa and more preferably more than 440 MPa, and their yield stress in the L and/or TL direction is typically more than 300 MPa and particularly preferably more than 320 MPa. They have good formability (elongation at failure in the L and/or TL direction preferably greater than 19% and more preferably greater than 20%). Their damage tolerance Kr, calculated from a R curve obtained according to ASTM E 561 for a value $\Delta a_{eff}$ equal to 60 mm, is preferably greater than 165 $MPa\sqrt{m}$ in the T-L and L-T directions, and more preferably greater than 180 $MPa\sqrt{m}$ in the L-T direction. Their crack propagation rate da/dN, determined according to ASTM standard E 647 in the T-L or the L-T direction for a value $\Delta K$ of 50 $MPa\sqrt{m}$ and a load ratio R=0.1, is preferably less than $2.5\times10^{-2}$ mm/cycle (and more preferably less than $2.0\times10^{-2}$ mm/cycle). This type of compromise between properties is particularly suitable for the use as fuselage skin. A sheet or plate according to the present invention, if desired, may be cladded on at least one face with an alloy in the 1xxx series, and preferably with an alloy selected from the group composed of the 1050, 1070, 1300 and 1145 alloys.

Considering the fact that riveting is a frequently used assembly mode for fuselage skins, cladded sheets and plates according to the invention are preferred for a fuselage skin application, since their resistance to corrosion caused by galvanic coupling in a riveted assembly is particularly good. More particularly, it is preferred to use cladded plates for which the galvanic corrosion current is less than 4 $\mu A/cm^2$, and preferably less than 2.5 $\mu A/cm^2$, for up to 200 hours' exposure during corrosion tests in a riveted assembly, when the core alloy is placed in an un-deaerated solution containing 0.06M of NaCl and the cladding alloy is placed in a solution of 0.02 M of $AlCl_3$ deaerated by nitrogen bubbling.

The following examples describe by way of illustration of advantageous embodiments of the invention. These examples are in no way limitative.

EXAMPLE 1

Four alloys N0, N1, N2 and N3 with a chemical composition according to the invention were elaborated. The liquid metal was treated firstly in the holding furnace by injecting gas using a type of rotor known under the trade mark IRMA, and then in a type of ladle known under the trade mark Alpur. Refining was done in line, in other words between the holding furnace and the Alpur ladle, with AT5B wire 0.7 kg/ton for N0, N1 and N3, and 0.3 kg/ton for N2). 3.0 m-long ingots were cast, with a section of 1450 mm×377 mm (except for N3:section 1450 mm×446 mm). They were was relaxed for 10 h at 350° C.

2024 alloy plates according to the prior art (references E and F) were also produced using the same process.

The chemical compositions of the N0, N1, N2, N3, E and F alloys measured on a spectrometry slug taken from the launder, are given in Table 1:

TABLE 1

| | Chemical composition | | | | | | |
|---|---|---|---|---|---|---|---|
| Alloy | Si | Fe | Cu | Mn | Mg | Zn | Cr |
| N0 | 0.03 | 0.08 | 4.16 | 0.41 | 1.35 | 0.59* | 0.001 |
| N1 | 0.03 | 0.08 | 4.00 | 0.40 | 1.22 | 0.63 | |
| N2 | 0.03 | 0.07 | 3.98 | 0.39 | 1.32 | 0.59 | |
| N3 | 0.06 | 0.07 | 4.14 | 0.43 | 1.26 | 1.28* | |
| E | 0.06 | 0.19 | 4.14 | 0.51 | 1.36 | 0.11 | 0.007 |
| F | 0.06 | 0.16 | 4.15 | 0.51 | 1.38 | 0.12 | 0.014 |
| 1050 cladding | 0.14 | 0.25 | 0.003 | 0.029 | 0.001 | 0.017 | |

*chemical analysis from liquid solution

In all cases, the 1050 alloy cladding occupies about 2% of the thickness.

For alloys according to the prior art (alloys E and F), the plates were reheated to about 450° C., and then hot rolled in a reversing rolling mill to a thickness of about 20 mm. The strips thus obtained were rolled on a three-roll stand tandem rolling mill until the final thickness was close to 5 mm, and were then coiled (at temperatures of 320° C. and 260° C., for alloys F and E respectively). For alloy F, the reel thus obtained was cold rolled to a thickness of 3.2 mm. Metal sheets were cut out, solution heat treated in a salt bath furnace at a temperature of 498.5° C. for a duration of 30 minutes (5 mm thick metal sheet E) or 25 minutes (3.2 mm thick metal sheet F), and then finished (crease recovery followed by controlled tension with permanent elongation between 1.5 and 3%).

Concerning the alloys according to the invention, ingot N0 was subjected to the following homogenisation cycle:

8 h at 495° C.+12 h at 500° C. (nominal values)

whereas ingots N1, N2 and N3 were subjected to a homogenisation of 12 h at 500° C.

After reheating (18 h between 425 and 445° C.), the ingots were hot rolled (input temperature: 413° C.) to a thickness of about 90 mm. The plate thus obtained was cut into two in the direction perpendicular to the rolling direction. The result was two strips, marked N01 and N02. These strips were rolled on a three-roll stand tandem hot rolling mill to a final thickness of 6 mm (coiling temperature about 320-325° C.).

A plate of alloys N1 and N3 and a plate of alloy N3 were hot-rolled to a thickness of 5.5 mm, and then cold-rolled to a final thickness of 3.2 mm. Another plate of alloy N1 was hot-rolled to 4.5 mm and then cold-rolled to the final thickness of 1.6 mm.

A plate of alloy N2 was hot-rolled to the final thickness of 6 mm (coiling temperature 270° C.).

The coil N01 was not subjected to any other rolling pass, while reel N02 was cold rolled to a final thickness of 3.2 mm.

After cutting into sheets, the products were solution heat treated in a salt bath furnace (thickness 6 mm: 60 minutes at 500° C.; thickness 3.2 mm: 40 minutes at 500° C.; thickness 1.6 mm: 30 minutes at 500° C.), followed by quenching in water at about 23° C. After quenching, a crease recovery operation was carried out on these sheets, and controlled stretching was applied to them to give an accumulated permanent elongation of between 1.5 and 3.5%. The waiting time between quenching and crease recovery did not exceed 6 hours.

The ultimate tensile strength $R_m$ (in MPa), the conventional yield stress at 0.2% elongation $R_{p0.2}$ (in MPa) and the elongation at failure A (in %) were measured by a tensile test according to EN 10002-1.

Table 2 contains the results of measurements of static mechanical characteristics in the T351 state:

TABLE 2

| | | Static mechanical characteristics | | | | | |
|---|---|---|---|---|---|---|---|
| | | L direction | | | TL direction | | |
| Metal Plate | T (mm) | Rm (MPa) | $R_{p0.2}$ (MPa) | A (%) | Rm (MPa) | $R_{p0.2}$ (MPa) | A (%) |
| N01 | 6.0 | 442 | 336 | 22.8 | 442 | 323 | 23.5 |
| N02 | 3.2 | 456 | 353 | 20.3 | 449 | 318 | 24.7 |

TABLE 2-continued

| | | Static mechanical characteristics | | | | | |
|---|---|---|---|---|---|---|---|
| | | L direction | | | TL direction | | |
| Metal Plate | T (mm) | Rm (MPa) | $R_{p0.2}$ (MPa) | A (%) | Rm (MPa) | $R_{p0.2}$ (MPa) | A (%) |
| N1 | 6.0 | 455 | 359 | 20.2 | 434 | 198 | 21.8 |
| N1 | 3.2 | 460 | 360 | 19.3 | 438 | 308 | 22.3 |
| N2 | 6 | 471 | 384 | 19.8 | 462 | 343 | 19.9 |
| N3 | 3.2 | 453 | 360 | 21.3 | 442 | 317 | 24.2 |
| E | 5.0 | Not measured | | | 456 | 341 | 17.7 |
| F | 3.2 | | | | 454 | 318 | 19.2 |

The formability, characterised by the ductility in tension (elongation value A) appears better for the alloy according to the invention, for the two thicknesses considered. The formability of sheet with a thickness of more than 4 mm was also characterised using the LDH (Limit Dome Height) test on 500 mm×500 mm formats in the T351 temper. The following results were obtained:

| | |
|---|---|
| Metal plate N01 (T 6 mm): | LDH = 81 mm |
| Metal plate E (T 5 mm): | LDH = 75 mm |

This confirms the better formability of the alloy according to the invention.

Damage tolerance was characterised in several ways. The R curve was measured according to ASTM standard E 561 on CCT type test pieces with width W=760 mm, 2a0=253 mm, e=sheet thickness, with control by displacement of the piston and a tension rate of 1 mm/min, using an anti-warp assembly made of steel. The test pieces were taken in the T-L direction and in the L-T direction. The value of $K_r$ (MPa$\sqrt{m}$) was calculated for different values of $\Delta a_{eff}$ (mm).

Table 3 shows the results:

TABLE 3

| | | | Results of the R curve test | | | | | |
|---|---|---|---|---|---|---|---|---|
| | T | | $K_r$(MPa✓m) for a value $\Delta a_{eff}$ equal to | | | | | |
| Sheet | (mm) | direction | 10 mm | 20 mm | 30 mm | 40 mm | 50 mm | 60 mm |
| N02 | 3.2 | T-L | 81 | 108 | 129 | 148 | 164 | 180 |
| N01 | 6.0 | T-L | 77 | 105 | 127 | 144 | 159 | 173 |
| N1 | 1.6 | T-L | 102 | 123 | 138 | 152 | 164 | 175 |
| N1 | 3.2 | T-L | 85 | 110 | 130 | 147 | 161 | 175 |
| N2 | 6 | T-L | 89 | 117 | 137 | 153 | 167 | 179 |
| N3 | 3.2 | T-L | 91 | 119 | 139 | 155 | 168 | 181 |
| F | 3.2 | T-L | 82 | 107 | 125 | 139 | 151 | 162 |
| E | 5.0 | T-L | 83 | 105 | 120 | 132 | 142 | 151 |
| N2 | 3.2 | L-T | 84 | 119 | 145 | 166 | 184 | 199 |
| N1 | 6.0 | L-T | 90 | 122 | 145 | 163 | 179 | 193 |
| N1 | 1.6 | L-T | 92 | 118 | 138 | 157 | 174 | 191 |
| N1 | 3.2 | L-T | 88 | 119 | 142 | 162 | 179 | 196 |
| N2 | 6 | L-T | 89 | 121 | 145 | 164 | 180 | 194 |
| N3 | 3.3 | L-T | 93 | 125 | 148 | 168 | 184 | 199 |
| E | 5.0 | L-T | 104 | 126 | 141 | 154 | 165 | 174 |

It can be seen that for high values of $\Delta a_{eff}$ (mm), the product according to the invention has higher values than the standard product made of the 2024 alloy.

Therefore the product according to the invention has better breaking strength in the case of a cracked panel.

The cracking rate da/dN (in mm/cycle) for different levels of ΔK (expressed in MPa√m) was determined according to standard ASTM E 647 on CCT type test pieces sampled in the T-L direction and the L-T direction, with a width W=400 mm, 2ao=4 mm, e=sheet thickness, under conditions R=0.1 and with a maximum stress of 120 MPa and an anti-warp device, for 3.2 mm thick test pieces. Table 4 shows the results.

TABLE 4

| | | | Results of the propagation rate test | | | | |
|---|---|---|---|---|---|---|---|
| | e | | da/dN (mm/cycle) for ΔK (MPa✓m)equal to | | | | |
| Sheet | (mm) | direction | 10 | 20 | 30 | 40 | 50 |
| N02 | 3.2 | T-L | $1.5 \times 10^{-4}$ | $6.5 \times 10^{-4}$ | $1.5 \times 10^{-3}$ | $0.4 \times 10^{-2}$ | $1.0 \times 10^{-2}$ |
| N01 | 6.0 | T-L | $1.5 \times 10^{-4}$ | $9.3 \times 10^{-4}$ | $1.8 \times 10^{-3}$ | $0.6 \times 10^{-2}$ | $1.4 \times 10^{-2}$ |
| N1 | 1.6 | T-L | $1.6 \times 10^{-4}$ | $4.6 \times 10^{-4}$ | $1.4 \times 10^{-3}$ | $0.4 \times 10^{-2}$ | $1.0 \times 10^{-2}$ |
| N1 | 3.2 | T-L | $1.8 \times 10^{-4}$ | $7.2 \times 10^{-4}$ | $1.6 \times 10^{-3}$ | $0.4 \times 10^{-2}$ | $1.0 \times 10^{-2}$ |
| N2 | 6 | T-L | $2.1 \times 10^{-4}$ | $8.7 \times 10^{-4}$ | $2.3 \times 10^{-3}$ | $0.6 \times 10^{-2}$ | $1.6 \times 10^{-2}$ |
| N3 | 3.2 | T-L | $1.6 \times 10^{-4}$ | $7.0 \times 10^{-4}$ | $1.4 \times 10^{-3}$ | $0.4 \times 10^{-2}$ | $0.8 \times 10^{-2}$ |
| F | 3.2 | T-L | $1.4 \times 10^{-4}$ | $8.2 \times 10^{-4}$ | $3.2 \times 10^{-3}$ | $1.0 \times 10^{-2}$ | $2.9 \times 10^{-2}$ |
| E | 5.0 | T-L | $1.9 \times 10^{-4}$ | $14.0 \times 10^{-4}$ | $6.1 \times 10^{-3}$ | $1.9 \times 10^{-2}$ | $4.4 \times 10^{-2}$ |
| N02 | 3.2 | L-T | $1.5 \times 10^{-4}$ | $5.4 \times 10^{-4}$ | $1.8 \times 10^{-3}$ | $0.5 \times 10^{-2}$ | $1.4 \times 10^{-2}$ |
| N01 | 6.0 | L-T | $1.8 \times 10^{-4}$ | $8.8 \times 10^{-4}$ | $1.4 \times 10^{-3}$ | $0.5 \times 10^{-2}$ | $1.1 \times 10^{-2}$ |
| N1 | 1.6 | L-T | $1.2 \times 10^{-4}$ | $4.2 \times 10^{-4}$ | $1.2 \times 10^{-3}$ | $0.3 \times 10^{-2}$ | $0.8 \times 10^{-2}$ |
| N1 | 3.2 | L-T | $1.7 \times 10^{-4}$ | $4.9 \times 10^{-4}$ | $1.8 \times 10^{-3}$ | $0.6 \times 10^{-2}$ | $1.6 \times 10^{-2}$ |
| N2 | 6.0 | L-T | $1.9 \times 10^{-4}$ | $10.4 \times 10^{-4}$ | $2.5 \times 10^{-3}$ | $0.7 \times 10^{-2}$ | $1.3 \times 10^{-2}$ |
| N3 | 3.2 | L-T | $1.7 \times 10^{-4}$ | $5.1 \times 10^{-4}$ | $1.6 \times 10^{-3}$ | $0.4 \times 10^{-2}$ | $1.0 \times 10^{-2}$ |
| E | 5.0 | L-T | $1.5 \times 10^{-4}$ | $7.6 \times 10^{-4}$ | $2.4 \times 10^{-3}$ | $0.8 \times 10^{-2}$ | $2.2 \times 10^{-2}$ |

It can be seen that the cracking rate of 2024 metal plates is two to three times faster than for the product according to the invention, particularly when ΔK≧20 MPa√m. Therefore, the product according to the invention enables inspection at longer intervals (for a given structure mass), or the weight of the structure can be reduced if the inspection intervals remain the same.

For the R curves and ΔK values, it should be noted that the most significant values regarding the behaviour of the real structure of an aircraft are within the range from 15 to 60 MPa√m. This is because fatigue stresses in a fuselage skin are usually of the order of 50 to 100 MPa for detectable defects of the order of 20 to 50 mm, knowing that $K=\sigma\sqrt{(\pi a)}$ where σ is the stress and the parameter a denotes the defect size.

For a space between stiffeners exceeding 100 mm, the values of K at failure for a limit load of more than 200 MPa are greater than about 120 MPa√m for the R curves described, with apparent K values (Kr) exceeding about 110 MPa√m. This means that the controlling portion of the R curve is composed of points corresponding to a more than 20 mm progress of the static crack $\Delta a_{eff}$.

The sheet corrosion resistance was also characterized. It was found that the intrinsic resistance to intergranular corrosion of the alloy according to the invention, in other words after removing the cladding by machining and measured according to the ASTM standard G 110 is very similar to the corresponding value for the reference 2024 alloy.

On cladded sheets, the measurement of the corrosion potential in the core and in the cladding according to ASTM standard G69 gave the results shown in Table 5 below. These results show that there is no significant difference in terms of the potential difference between the core and the cladding (characteristic of the cathodic protection capacity of cladding). This is surprising since in line with published data (see particularly "ASM Handbook", 9$^{th}$ Edition, Volume 13, "Corrosion", page 584, FIG. 5), the addition of zinc into an aluminium alloy significantly reduces the corrosion potential, which should have the effect of limiting the potential difference between the core and the cladding of the alloy according to the invention.

TABLE 5

| | | Potentials (mV/ECS) and potential differences (mV) | | |
|---|---|---|---|---|
| Metal Plate | t (mm) | Core potential (mV/ECS) | Cladding potential (mV/ECS) | Potential difference (Mv) |
| N02 | 3.2 | −620 | −768 | 148 |
| N01 | 6.0 | −611 | −801 | 190 |
| N1 | 1.6 | −634 | −772 | 138 |
| N1 | 3.2 | −632 | −775 | 143 |
| N2 | 6 | −636 | −770 | 134 |
| N3 | 3.2 | −636 | −755 | 119 |
| E | 5.0 | −609 | −775 | 166 |

On the other hand, and surprisingly, it is found that during a corrosion test due to galvanic coupling in a riveted assembly, the product according to the invention behaves significantly better. According to the Applicant's observations, this test that was for example described in patent EP 0 623 462 B1 (incorporated herein by reference in its entirety), is particularly suitable for evaluating the aptitude of cladded metal plates for use in aeronautical construction. The test consists in measuring the current set up naturally between the anode (cladding alloy placed in a cell containing a solution of $AlCl_3$ (0.02 M, deaerated)) and the cathode (core alloy placed in a cell containing a solution of NaCl (0.06 M, aerated)), the electrolytic contact between the two cells being formed by a salt bridge. The two elements (cladding and core) have the same surface area (2.54 $cm^2$).

The densities of the coupling current are recorded throughout the test period. It is observed that the current reaches a peak after about 55 hours and then hardly changes throughout the rest of the test duration (200 h or 15 days depending on the sample). Table 6 contains a summary of the results.

TABLE 6

| Electrochemical simulation of the assembly | | | | |
|---|---|---|---|---|
| Sheet | N2 | N1 | F | E |
| Peak current after 55 hours ($\mu A/cm^2$) | 1.6 | 1.2 | 2.8 | 2.4 |
| Measured mass loss ($mg/cm^2$) after 5 days of tests | 1.06 | 0.79 | 1.57 | Not measured |

As a comparison, the examples described in patent EP 0 623 462 B1 give a peak current of 3.1 $\mu A/cm^2$ for the 2024 standard alloy with 1070 alloy cladding.

It is found that the corrosion current and the mass loss of the product according to the invention (N1 and N2) are much lower than for the standard product according to the prior art. For some applications, for example for structural members of an aircraft, this is a very significant advantage in terms of lifespan.

EXAMPLE 2

Several other metallurgical tempers were produced from hot rolled and possibly cold rolled sheets (F temper) of the alloy according to the invention (see Example 1), in the form of sheet with dimensions 600 mm (L direction)×160 mm (TL direction)×thickness. 3.2 mm thick as-rolled sheets (cold rolled) or 6.0 mm thick as-rolled sheets (hot rolled) were subjected to solution heat treatment followed by quenching, aging and controlled tension, as shown in Table 7:

TABLE 7

| Conditions for production of the sheets in Example 2 | | | | |
|---|---|---|---|---|
| Mark | Thickness (mm) | Solution heat treatment duration at 500° C. (min) | Aging duration | Controlled stretching |
| N0A | 3.2 | 30 | <2 h | 2% |
| N0B | 3.2 | 30 | <2 h | 4% |
| N0C | 3.2 | 30 | <2 h | 6% |
| N0D | 3.2 | 30 | 24 h | 2% |
| N0E | 3.2 | 30 | 24 h | 6% |
| N0F | 6.0 | 40 | <2 h | 2% |
| N0G | 6.0 | 40 | <2 h | 4% |
| N0H | 6.0 | 40 | <2 h | 6% |
| N0I | 6.0 | 40 | 24 h | 2% |
| N0J | 6.0 | 40 | 24 h | 6% |

The marks ending in A, D , F and I correspond to T351 tempers. The different samples were characterized by tensile tests (L and TL directions) and by toughness tests.

First, the toughness was evaluated in the T-L and L-T directions using the maximum stress $R_e$ (in MPa) and the creep energy $E_{ec}$ as derived using the Kahn test. The Kahn stress is equal to the ratio of the maximum load $F_{max}$ that the test piece can resist on the cross section of the test piece (product of the thickness B and the width W). The creep energy is determined as the area under the Force-Displacement curve as far as the maximum force $F_{max}$ resisted by the test piece. The test is described in the article entitled "Kahn-Type Tear Test and Crack Toughness of Aluminum Alloy Sheet" published in the Materials Research & Standards Journal, April 1964, p. 151-155. For example, the test piece used for the Kahn toughness test is described in the "Metals Handbook", $8^{th}$ Edition, vol. 1, American Society for Metals, pp. 241-242.

Toughness was also considered for 6 mm thick sheets, using an R curve test in the T-L direction but on smaller test pieces than the test piece described in Example 1. CT type test pieces with width W=127 mm, $a_0$ =38.5 mm, e=sheet thickness were used, with control over the piston displacement and a tension rate of 1 mm/min. Tables 8 and 9 below show the different results.

TABLE 8

| Static mechanical characteristics | | | | | | | | |
|---|---|---|---|---|---|---|---|---|
| | | | Static characteristics L direction | | | Static characteristics TL direction | | |
| Mark | Aging | Tension | $R_m$ (MPa) | $R_{p0.2}$ (MPa) | A (%) | $R_m$ (MPa) | $R_{p0.2}$ (MPa) | A (%) |
| N0A | <2 h | 2% | 450 | 345 | 21.6 | 444 | 307 | 23.7 |
| N0B | <2 h | 4% | 456 | 369 | 21.4 | 448 | 322 | 21.1 |
| N0C | <2 h | 6% | 464 | 394 | 17.6 | 453 | 339 | 18.2 |
| N0D | 24 h | 2% | 457 | 351 | 22.1 | 449 | 313 | 23.2 |
| N0E | 24 h | 6% | 473 | 413 | 18.7 | 464 | 352 | 18.6 |
| N0F | <2 h | 2% | 433 | 334 | 22.5 | 432 | 297 | 21.5 |
| N0G | <2 h | 4% | 437 | 353 | 22.3 | 436 | 308 | 21.1 |
| N0H | <2 h | 6% | 443 | 375 | 19.5 | 443 | 324 | 20.9 |
| N0I | 24 h | 2% | 440 | 338 | 24.1 | 443 | 308 | 23.1 |
| NOJ | 24 h | 6% | 459 | 399 | 20.2 | 460 | 347 | 18.6 |

TABLE 9

| | | | Toughness characteristics | | | |
|---|---|---|---|---|---|---|
| | | | Test on "Kahn" test piece $R_e$(MPa)/$E_{ec}$(J) | | R curve test on CT127 test piece | |
| | | | T-L | L-T | T-L direction | |
| Mark | Maturing | Tension | direction | direction | $K_{app}$(MPa✓m) | $K_{eff}$(MPa✓m) |
| N0A | <2 h | 2% | 163/15.0 | 166/15.4 | Not measured | |
| N0B | <2 h | 4% | 164/13.3 | 169/13.7 | Not measured | |
| N0C | <2 h | 6% | 167/12.3 | 172/12.9 | Not measured | |
| N0D | 24 h | 2% | 164/14.3 | 168/15.5 | Not measured | |
| N0E | 24 h | 6% | 172/12.0 | 176/12.4 | Not measured | |
| N0F | <2 h | 2% | 160/29.0 | 163/30.7 | 99.3 | 149.2 |
| N0G | <2 h | 4% | 165/28.4 | 166/27.8 | 99.9 | 137.6 |
| N0H | <2 h | 6% | 167/25.5 | 167/25.1 | 93.8 | 125.5 |
| NOI | 24 h | 2% | 165/30.0 | 165/28.9 | 99.6 | 149.3 |
| NOJ | 24 h | 6% | 172/24.0 | 172/24.2 | 101.1 | 137.1 |

EXAMPLE 3

Sheets produced as described in example 2 were strain-hardened by controlled stretching (permanent set 5%) after quenching. The results of measurements are shown in tables 10 and 11.

TABLE 10

| | | Statical mechanical characteristics | | | | | |
|---|---|---|---|---|---|---|---|
| | | L direction | | | LT direction | | |
| Sheet | thick [mm] | Rm [MPa] | $R_{p0,2}$ [MPa] | A [%] | Rm [MPa] | $R_{p0,2}$ [MPa] | A [%] |
| N1 | 1.6 | 468 | 404 | 20.1 | 456 | 341 | 20.6 |
| N1 | 3.2 | 472 | 408 | 18.2 | 464 | 348 | 19.3 |
| N2 | 6 | 488 | 422 | 19.1 | 475 | 368 | 20.2 |

TABLE 11

| | | | R curve results on stretched sheet (5% permanent set) | | | | | |
|---|---|---|---|---|---|---|---|---|
| | thick | | $K_r$ [MPa✓m] for a value $\Delta a_{eff}$ of | | | | | |
| Sheet | [mm] | Dir | 10 mm | 20 mm | 30 mm | 40 mm | 50 mm | 60 mm |
| N1 | 1.6 | T-L | 66 | 91 | 112 | 130 | 148 | 164 |
| N1 | 3.2 | T-L | 96 | 124 | 144 | 160 | 173 | 186 |
| N2 | 6 | T-L | 84 | 111 | 131 | 147 | 161 | 173 |
| N1 | 1.6 | L-T | 86 | 111 | 132 | 152 | 171 | 189 |
| N1 | 3.2 | L-T | 101 | 133 | 157 | 178 | 195 | 212 |
| N2 | 6 | L-T | 82 | 112 | 136 | 157 | 175 | 192 |

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

All documents referred to herein are specifically incorporated herein by reference in their entireties.

As used herein and in the following claims, articles such as "the", "a" and "an" can connote the singular or plural.

What is claimed is:

1. A wrought product comprising an AlCuMg type alloy wherein Zn is added to said alloy in a certain controlled quantity to provide the following composition (% by weight):

Cu 3.80-4.30; Mg 1.25-1.45; Mn 0.20-0.50; Zn 0.5-0.7; Fe<0.15; Si<0.15; Zr≦0.05; Ag<0.01 other elements<0.05 each and<0.15 total, remainder Al.

2. Product according to claim 1, wherein Cu 4.05-4.30.

3. Product according to claim 1, wherein Mg 1.28-1.42.

4. Product as claimed in claim 1, wherein Mn 0.30-0.50.

5. Product as claimed in claim 1, wherein Fe<0.10.

6. Product as claimed in claim 1, wherein Si<0.10.

7. Product as claimed in claim 1, wherein Cu<4.20; Mg<1.38; Mn<0.42; and Zn≧(1.2Cu−0.3Mg+0.3Mn−3.75).

8. Product as claimed in claim 1, wherein said product has been treated with a solution heat treatment, quenching and cold strain-hardening, and possesses a permanent set between 0.5% and 15%.

9. Product as claimed in claim 1, wherein said product is a sheet or plate between 1 and 16 mm thick.

10. Product as claimed in claim 1, wherein said sheet or plate is clad on at least one face thereof with an alloy in the 1xxx series.

11. Product as claimed in claim 1, having an ultimate tensile strength in the L and/or TL direction that is more than 430 MPa.

12. Product as claimed in claim 1, having a yield stress in the L and/or TL direction that is more than 300 MPa.

13. Product as claimed in claim 1, having an elongation at failure in the L and/or TL direction that is greater than 19%.

14. Product as claimed in claim 1, having a damage tolerance Kr calculated from a R curve obtained according to ASTM E 561 for a value $\Delta a_{eff}$ equal to 60 mm that is greater than 165 MPa$\sqrt{m}$ in the T-L and L-T directions.

15. Product as claimed in claim 1, having a damage tolerance Kr calculated from a R curve obtained according to ASTM E 561 for a value $\Delta a_{eff}$ equal to 60 mm that is greater than 180 MPa$\sqrt{m}$ in the L-T direction.

16. Product as claimed in claim 1, having a crack propagation rate da/dN determined according to ASTM standard E 647 in the T-L or the L-T direction for a load ratio R=0.1 and a value ΔK of 50 MPa$\sqrt{m}$, that is less than $2.5\times10^{-2}$ mm/cycle.

17. A clad sheet or plate as claimed in claim 1, wherein the galvanic corrosion current is smaller than 4 μA/cm$^2$ for an exposure of a riveted assembly to a corrosion test up to 200 hours, in which the cladding alloy is placed in a cell containing a solution of $AlCl_3$ (0.02 M, deaerated by nitrogen bubbling) and the core alloy placed in a cell containing a solution of NaCl (0.02 M, aerated).

18. Clad metal sheet or plate as claimed in claim 17, wherein said galvanic corrosion current is less than 2.5 μA/cm$^2$.

19. Aircraft structural member made from at least one product as claimed in claim 1.

20. Structural element as claimed in claim 19, wherein said structural member is a member of the skin of a fuselage.

21. Method for the production of a wrought product according to claim 1, comprising:

(a) casting a rolling, forging or extrusion ingot, (b) homogenizing said ingot between 450 and 500° C., (c) hot transforming said ingot by extruding, rolling or forging to form an intermediate product, (d) optionally cold transforming said intermediate product, (e) solution heat treating said intermediate product at a temperature of between 480 and 505° C., (f) quenching, (g) cold working with a permanent set comprised between 0.5 and 15%.

22. Method according to claim 21, wherein the cold working is done with a permanent set comprised between 1 and 5%.

23. A method according to claim 21, wherein the permanent set is between 1.5 and 3.5%.

24. A product according to claim 16, wherein the crack propagation is less than $2.0\times10^{-2}$ mm/cycle.

25. Product as claimed in claim 1, having an elongation at failure in the L and/or TL direction that is greater than 20%.

26. Product as claimed in claim 1, having a yield stress in the L and/or TL direction that is more than 320 MPa. and/or having an ultimate tensile strength in the L and/or TL direction that is more than 440 MPa.

27. Product as claimed in claim 1, wherein said sheet or plate is clad on at least one face thereof with an alloy selected from the group consisting of the 1050, 1070, 1300 and 1145 alloys.

28. Product as claimed in claim 1, wherein Mn 0.35-0.48.

29. Product as claimed in claim 1, wherein said product has been treated with a solution heat treatment, quenching and cold strain-hardening, and possesses a permanent set between 1% and 5%.

30. Product as claimed in claim 29, wherein said permanent set is between 1.5% and 3.5%.

31. A product according to claim 1 that is rolled, extruded and/or forged.

32. A clad sheet or plate of claim 1 that is substantially free of Zr and Ag.

33. A clad sheet or plate of claim 2 that is substantially free of Zr and Ag.

34. A clad sheet or plate of 32 wherein an alloy used to form said sheet has Fe and Si>0.06%.

35. A clad sheet or plate of 33 wherein an alloy used to form said sheet has Fe and Si>0.06%.

36. A product according to claim 1 that is rolled, extruded and/or forged.

37. A sheet or plate of claim 1 that is substantially recrystallized and has an equiaxed grain structure.

38. A sheet or plate formed of an AlCuMg type alloy having a certain controlled quantity of Zn from 0.5-0.7% added thereto, wherein said sheet or plate possesses substantially equivalent mechanical strength and formability but better damage tolerance and corrosion resistance than a sheet or plate formed of an alloy with less than about 0.25% Zn, that is a wrought product comprising an AlCuMg type alloy of the following composition (% by weight):

Cu 3.80-4.30; Mg 1.25-1.45; Mn 0.20-0.50; Zn 0.5-0.7; Fe<0.15; Si<0.15; Zr≦0.05; Ag<0.01 other elements<0.05 each and<0.15 total, remainder Al.

39. Product according to claim 38, wherein Cu 4.05-4.30.

40. Product according to claim 38, wherein Mg 1.28-1.42.

41. Product as claimed in claim 38, wherein Mn 0.30-0.50.

42. Product as claimed in claim 38, wherein Fe<0.10.

43. Product as claimed in claim 38, wherein Si<0.10.

44. A sheet or plate according to claim 38, wherein Cu<4.20; Mg<1.38; Mn<0.42; and Zn≧(1.2Cu−0.3Mg+0.3Mn−3.75).

45. Product as claimed in claim 38, wherein said product has been treated with a solution heat treatment, quenching and cold strain-hardening, and possesses a permanent set between 0.5% and 15%.

46. Product as claimed in claim 38, wherein said product is a sheet or plate between 1 and 16 mm thick.

47. Product as claimed in claim 38, wherein said sheet or plate is clad on at least one face thereof with an alloy in the 1xxx series.

48. Product as claimed in claim 38, having an ultimate tensile strength in the L and/or TL direction that is more than 430 MPa.

49. Product as claimed in claim 38, having a yield stress in the L and/or TL direction that is more than 300 MPa.

50. Product as claimed in claim 38, having an elongation at failure in the L and/or TL direction that is greater than 19%.

51. Product as claimed in claim 38, having a damage tolerance Kr calculated from a R curve obtained according to ASTM H 561 for a value $\Delta a_{eff}$ equal to 60 mm that is greater than 165 MPa$\sqrt{m}$ in the T-L and L-T directions.

52. Product as claimed in claim 38, having a damage tolerance Kr calculated from a R curve obtained according to ASTM H 561 for a value $\Delta a_{eff}$ equal to 60 mm that is greater than 180 MPa$\sqrt{m}$ in the L-T direction.

53. Product as claimed in claim 38, wherein its crack propagation rate da/dN determined according to ASTM standard H 647 in the T-L or the L-T direction for a load ratio R=0.1 and a value ΔK of 50 MPa$\sqrt{m}$, is less than $2.5\times10^{-2}$ mm/cycle.

54. A clad sheet or plate as claimed in claim 38, wherein the galvanic corrosion current is smaller than 4 μA/cm$^2$ for an exposure of a riveted assembly to a corrosion test up to 200 hours, in which the cladding alloy is placed in a cell containing a solution of $AlCl_3$ (0.02 M, deaerated by nitrogen bubbling)) and the core alloy placed in a cell containing a solution of NaCl (0.02 M, aerated).

55. Clad metal sheet or plate as claimed in claim 54, wherein said galvanic corrosion current is less than 2.5 $\mu A/cm^2$.

56. Aircraft structural member made from at least one product as claimed in claim 38.

57. Structural element as claimed in claim 56, wherein said structural member is a member of the skin of a fuselage.

58. Method for the production of a wrought product according to claim 38, comprising:

(a) casting a rolling, forging or extrusion ingot, (b) homogenizing said ingot between 450 and 500° C., (c) hot transforming said ingot by extruding, rolling or forging to form an intermediate product, (d) optionally cold transforming said intermediate product, (e) solution heat treating said intermediate product at a temperature of between 480 and 505° C., (f) quenching, (g) cold working with a permanent set comprised between 0.5 and 15%.

59. Method according to claim 58, wherein the cold working is done with a permanent set comprised between 1 and 5%.

60. A method according to claim 58, wherein the permanent set is between 1.5 and 3.5%.

61. Product as claimed in claim 38, having an elongation at failure in the L and/or TL direction that is greater than 20%.

62. Product as claimed in claim 38, having a yield stress in the L and/or TL direction that is more than 320 MPa.

63. Product as claimed in claim 38, having an ultimate tensile strength in the L and/or TL direction that is more than 440 MPa.

64. Product as claimed in claim 38, wherein said sheet or plate is clad on at least one face thereof with an alloy selected from the group consisting of the 1050, 1070, 1300 and 1145 alloys.

65. Product as claimed in claim 38, wherein Mn 0.35-0.48.

66. Product as claimed in claim 38, wherein said product has been treated with a solution heat treatment, quenching and cold strain-hardening, and possesses a permanent set between 1% and 5%.

67. Product as claimed in claim 66, wherein said permanent set is between 1.5% and 3.5%.

* * * * *